US008646430B2

(12) United States Patent
Kinoshita

(10) Patent No.: US 8,646,430 B2
(45) **Date of Patent: *Feb. 11, 2014**

(54) SMALL PLANING BOAT

(75) Inventor: Yoshimasa Kinoshita, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1557 days.

This patent is subject to a terminal disclaimer.

(21) Appl. No.: 12/189,069

(22) Filed: Aug. 8, 2008

(65) Prior Publication Data

US 2009/0042463 A1 Feb. 12, 2009

Related U.S. Application Data

(63) Continuation-in-part of application No. 11/965,290, filed on Dec. 27, 2007, now Pat. No. 7,654,242.

(30) Foreign Application Priority Data

Aug. 10, 2007 (JP) ..... 2007-209864
Jun. 12, 2008 (JP) ..... 2008-154058

(51) Int. Cl.
*F02D 13/06* (2006.01)

(52) U.S. Cl.
USPC ..... 123/198 F; 123/198 DB; 123/643; 440/38; 440/1

(58) Field of Classification Search
USPC ..... 123/198 F, 198 D, 198 DC, 339.11, 352, 123/509, 481, 198 DB, 643; 440/40.1, 84, 440/87, 1, 38
See application file for complete search history.

(56) References Cited

U.S. PATENT DOCUMENTS

| | | | | |
|---|---|---|---|---|
| 6,068,528 | A * | 5/2000 | Suzuki | 440/1 |
| 6,263,839 | B1 * | 7/2001 | Hoshiba et al. | 123/41.08 |
| 6,360,724 | B1 * | 3/2002 | Suhre et al. | 123/481 |
| 7,654,242 | B2 * | 2/2010 | Kinoshita | 123/198 F |
| 2010/0050993 | A1 * | 3/2010 | Zhao et al. | 123/481 |

FOREIGN PATENT DOCUMENTS

JP 2002-371875 12/2002

* cited by examiner

*Primary Examiner* — Rinaldi Rada
*Assistant Examiner* — Kevin Lathers
(74) *Attorney, Agent, or Firm* — Keating & Bennett, LLP

(57) ABSTRACT

A small planing boat includes a multi-cylinder engine, and a propulsion unit driven by the engine for propelling a hull by drawing up and jetting out water. The engine can be configured to change the number of deactivated cylinders in a phased manner corresponding to an engine speed when the engine speed becomes a prescribed speed or more, and can include a memory for storing cylinder deactivation sequence schedules for determining sequences of cylinders that are deactivated and increasing the number of deactivated cylinders in a phased manner. An operation control device configured to deactivate the cylinders of the engine in a phased manner in accordance with the cylinder deactivation sequence schedules stored in the memory. The operation control device shifts the cylinder deactivation sequence schedules to be read out from the memory to another cylinder deactivation sequence schedule corresponding to an operational state of the engine.

13 Claims, 7 Drawing Sheets

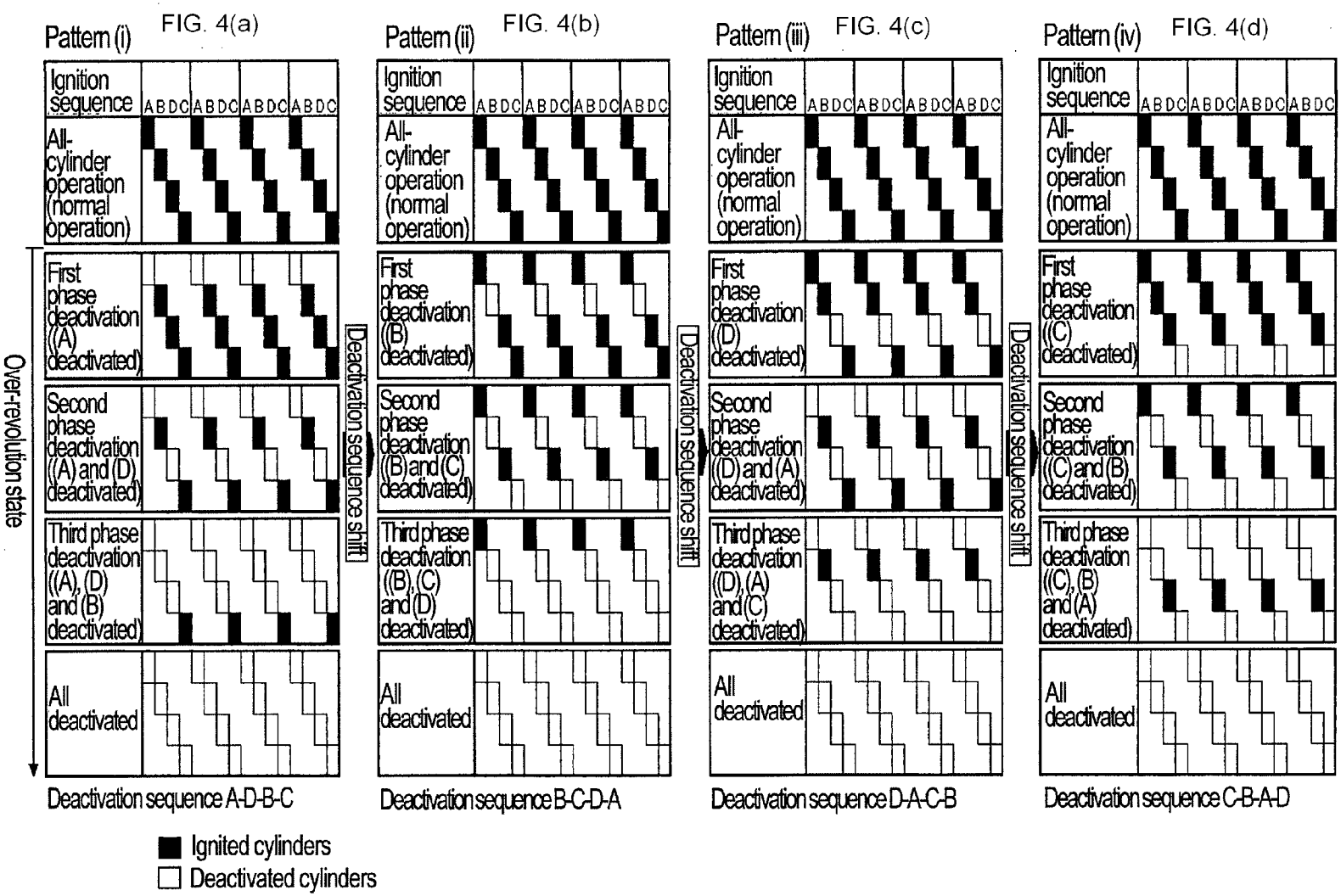
FIG. 4(a)
FIG. 4(b)
FIG. 4(c)
FIG. 4(d)
Pattern (i)
Pattern (ii)
Pattern (iii)
Pattern (iv)
Ignition sequence
A B D C A B D C A B D C A B D C
All-cylinder operation (normal operation)
First phase deactivation ((A) deactivated)
First phase deactivation ((B) deactivated)
First phase deactivation ((D) deactivated)
First phase deactivation ((C) deactivated)
Second phase deactivation ((A) and (D) deactivated)
Second phase deactivation ((B) and (C) deactivated)
Second phase deactivation ((D) and (A) deactivated)
Second phase deactivation ((C) and (B) deactivated)
Third phase deactivation ((A), (D) and (B) deactivated)
Third phase deactivation ((B), (C) and (D) deactivated)
Third phase deactivation ((D), (A) and (C) deactivated)
Third phase deactivation ((C), (B) and (A) deactivated)
All deactivated
Deactivation sequence A-D-B-C
Deactivation sequence B-C-D-A
Deactivation sequence D-A-C-B
Deactivation sequence C-B-A-D
Deactivation sequence shift
Deactivation sequence shift
Deactivation sequence shift
Over-revolution state
Ignited cylinders
Deactivated cylinders

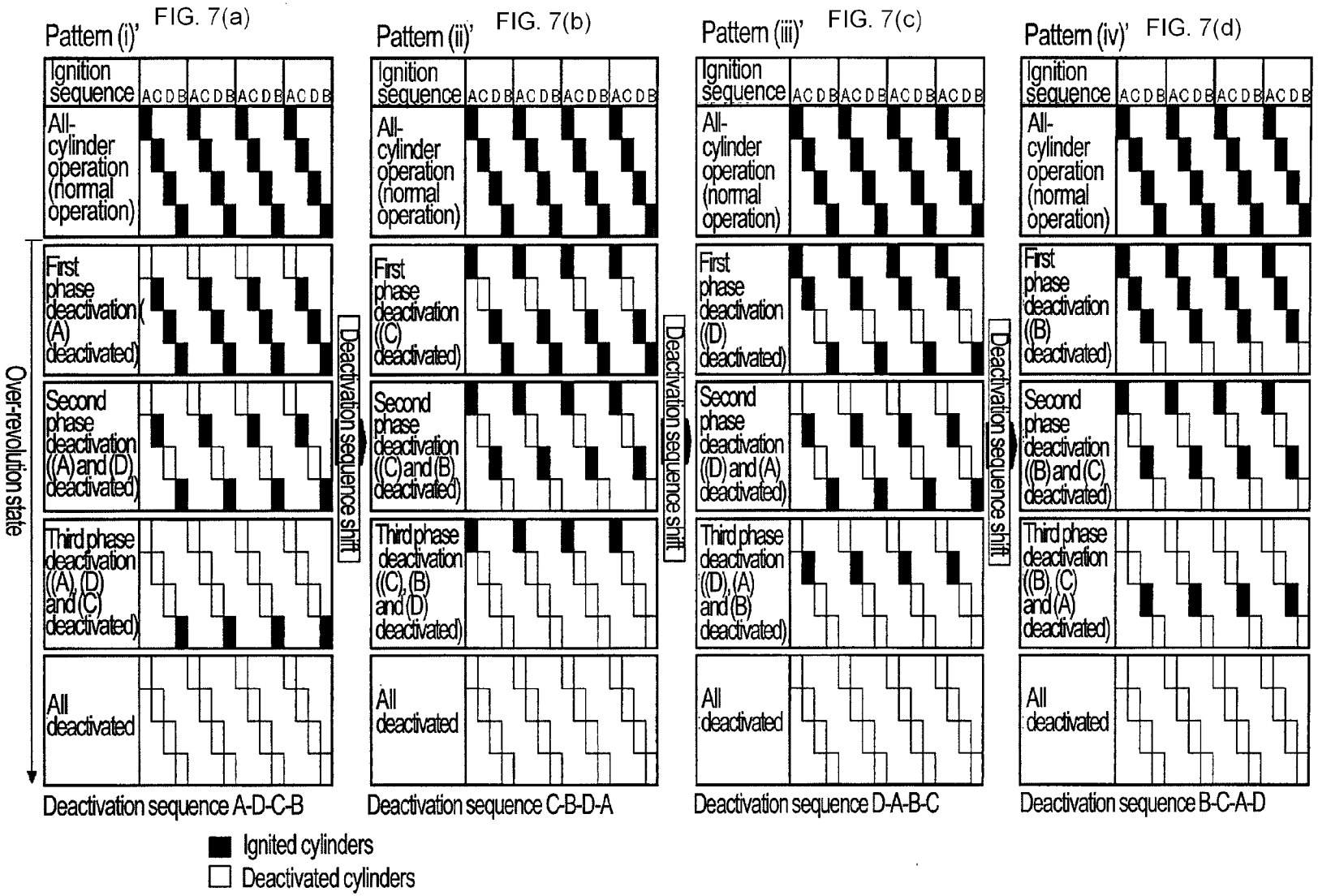
FIG. 7(a)
Pattern (i)'
Ignition sequence
A C D B A C D B A C D B A C D B
All-cylinder operation (normal operation)
First phase deactivation ((A) deactivated)
Second phase deactivation ((A) and (D) deactivated)
Third phase deactivation ((A), (D) and (C) deactivated)
All deactivated
Deactivation sequence A-D-C-B
Deactivation sequence shift
FIG. 7(b)
Pattern (ii)'
Ignition sequence
A C D B A C D B A C D B A C D B
All-cylinder operation (normal operation)
First phase deactivation ((C) deactivated)
Second phase deactivation ((C) and (B) deactivated)
Third phase deactivation ((C), (B) and (D) deactivated)
All deactivated
Deactivation sequence C-B-D-A
Deactivation sequence shift
FIG. 7(c)
Pattern (iii)'
Ignition sequence
A C D B A C D B A C D B A C D B
All-cylinder operation (normal operation)
First phase deactivation ((D) deactivated)
Second phase deactivation ((D) and (A) deactivated)
Third phase deactivation ((D), (A) and (B) deactivated)
All deactivated
Deactivation sequence D-A-B-C
Deactivation sequence shift
FIG. 7(d)
Pattern (iv)'
Ignition sequence
A C D B A C D B A C D B A C D B
All-cylinder operation (normal operation)
First phase deactivation ((B) deactivated)
Second phase deactivation ((B) and (C) deactivated)
Third phase deactivation ((B), (C) and (A) deactivated)
All deactivated
Deactivation sequence B-C-A-D
Over-revolution state
Ignited cylinders
Deactivated cylinders

SMALL PLANING BOAT

PRIORITY INFORMATION

The present application is based on and claims priority under 35 U.S.C. §119(a-d) to Japanese Patent Application No. 2007-209864, filed on Aug. 10, 2007, Japanese Patent Application No. 2008-154058, filed on Jun. 12, 2008 and is a Continuation-in-Part of U.S. patent application Ser. No. 11/965,290 filed Dec. 27, 2007, the entire contents of all of which is expressly incorporated by reference herein.

BACKGROUND OF THE INVENTIONS

1. Field of the Inventions

The present inventions relate to a small planing boats which have a multi-cylinder engines including operation control devices which change deactivated cylinders in a phased manner, for example, corresponding to an engine speed when the engine speed reaches or exceeds a predetermined speed.

2. Description of the Related Art

Small planing boats are frequently driven with their throttle valve at large openings and/or fully opened. During such operation, the engine speed can exceed the maximum recommended speed (the "over-revolution state") when, for example, air is drawn into the jet pump. Thus, in order to prevent discomfort that can from such over-revolution of the engine, some conventional small planing watercraft designs include devices for deactivating each cylinder of the engine in a phased manner when the engine speed exceeds a predetermined speed, to thereby prevent the engine from reaching an over-revolution state. For example, Japanese Patent Document JP-A-2002-371875 discloses such a design.

In this watercraft design, the cylinders are deactivated one after another during an over-revolution state. More particularly, the number of deactivated cylinders is gradually increased, thereby reducing rotational fluctuations while lowering the engine speed. This helps to further improve rider comfort, for example, when the over-revolution state is frequently repeated.

SUMMARY OF THE INVENTIONS

As noted above, small planing boats can include jet-pump type propulsion systems. In these types of propulsion systems, the jet pump draws water up from the body of water in which the boat operates and jets the water out rearwardly to generate a propulsive force. A water inlet port is provided on a bottom of the boat, forward from the stern. An engine is usually disposed at about the center of the hull of the small planing boat. Therefore, under some operating conditions, the water inlet port can be exposed to the air while the boat is planing, and thus the jet pump draws air in. When the jet pump draws in air, the load on the impeller within the jet pump, and thus the load on the engine, drops suddenly, allowing the engine speed to rise quickly. This tends to result in an over-revolution state and can cause discomfort for the riders.

The operational comfort can be improved by the phased deactivations used in the known techniques described above. However, in those techniques, the cylinders are deactivated according to the same sequence. As a result, the cylinders that are scheduled to be deactivated later in the sequence are deactivated less often than the cylinders that are scheduled to be deactivated earlier in the sequence. That is because over-revolution states do not always last long enough for the controller to reach the end of the deactivation sequence.

As such, the cylinders scheduled to be deactivated later in the sequence are subject to the over-revolution state for longer periods. That is because when an over-revolution state is reached, and a phased deactivation process begins, the cylinders that are not deactivated first continue to operate even though the engine speed is above the predetermined speed. Thus, these cylinders are operated during the over-revolution state, and thereby power and thermal loads are unevenly distributed among the cylinders, which causes faster abrasion and deterioration in the cylinders that are scheduled to be deactivated later in the sequence. Therefore, to provide a desired durability and engine lifespan, the engine should be made thicker or larger in certain areas, which results in difficulties in fitting such an engine in the small engine compartments of small planing type watercraft.

In contrast, automobiles include transmissions, and thus automobile engines are not typically subjected to repeated over-revolution like the engines of small planing type watercraft. Outboard motors include propellers positioned below the stern of the associated ship, below or at the same level as the ship bottom, and the watercraft often runs with its front part up (and its rear part down). Therefore, the propellers of outboard motor powered watercraft are also less likely to be exposed to the air and thus the associated engines are less often subject to the over-revolution state.

Further, the center of gravity of outboard motor powered watercraft generally tends to be positioned toward the rear of the associated watercraft since the outboard motor is disposed at a rear end of the watercraft. Therefore, the rear part of the watercraft is usually positioned lower relative to the front part. The propeller, thus, is less likely to be exposed to the air for such a reason and thus the engine is less often subject to the over-revolution state.

Thus, in accordance with an embodiment, a small planing boat can comprise a multi-cylinder engine and a jet pump configured to be driven by the engine and to propel a hull by drawing in and jetting out water. The engine can be configured to change the number of deactivated cylinders in a phased manner corresponding to a speed of the engine when the engine speed becomes a prescribed speed or more. The engine can further comprise a memory device for storing a plurality of cylinder deactivation sequence schedules defining sequences of cylinders that are deactivated and increasing the number of deactivated cylinders in a phased manner. An operation control device can be configured to deactivate the cylinders of the engine in a phased manner in accordance with the cylinder deactivation sequence schedule stored in the memory device. The operation control device can be configured to shift the cylinder deactivation sequence schedule to be read out from the memory device to another cylinder deactivation sequence schedule corresponding to an operational state of the engine.

"Operational state" can refer to, for example but without limitation, states where the engine speed is lower than a prescribed speed, an operation amount of a throttle operator becomes less than a prescribed amount, the engine is stopped, the engine is started, etc.

BRIEF DESCRIPTION OF THE DRAWINGS

The above-mentioned and other features of the inventions disclosed herein are described below with reference to the drawings of preferred embodiments. The illustrated embodiments are intended to illustrate, but not to limit the inventions. The drawings contain the following Figures:

FIGS. 4(*a*)-4(*d*) include charts showing a examples of cylinder deactivation sequence schedules that can be used in the operation of the engine.

FIGS. 7(*a*)-7(*d*) include charts showing modifications of the example cylinder deactivation sequence schedules of FIG. 4.

DETAILED DESCRIPTION OF THE PREFERRED EMBODIMENTS

FIGS. 1 through 6 are drawings for describing a small planing boat 1 including a multi-cylinder engine in accordance with various embodiments. The various embodiments of the multi-cylinder engine are disclosed in the context of a small planing boat because it has particular utility in this context. However, the engines disclosed herein can be used in other contexts, such as, for example, but without limitation, engines of other vehicles including land vehicles and water vehicles.

Figure 1:
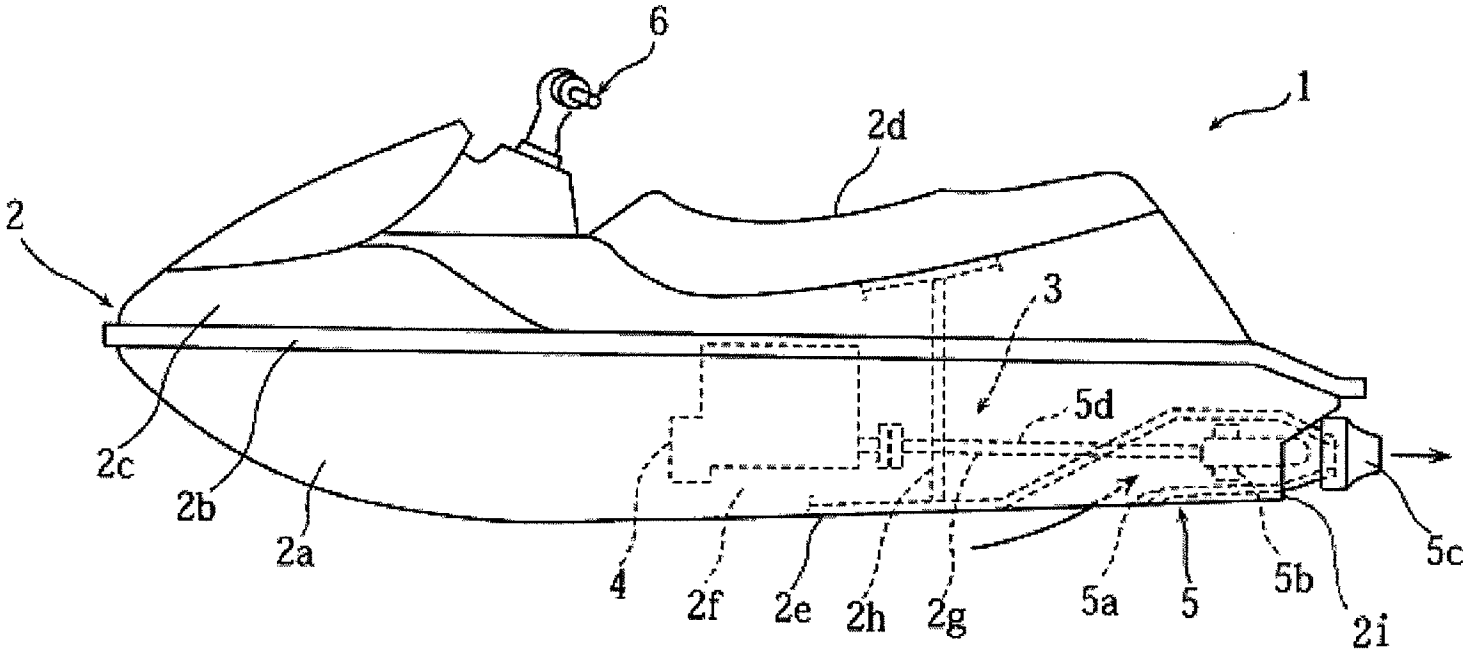
FIG. 1 is a left side view of a small planing boat including a multi-cylinder engine in accordance with an embodiment.
Figure 2:
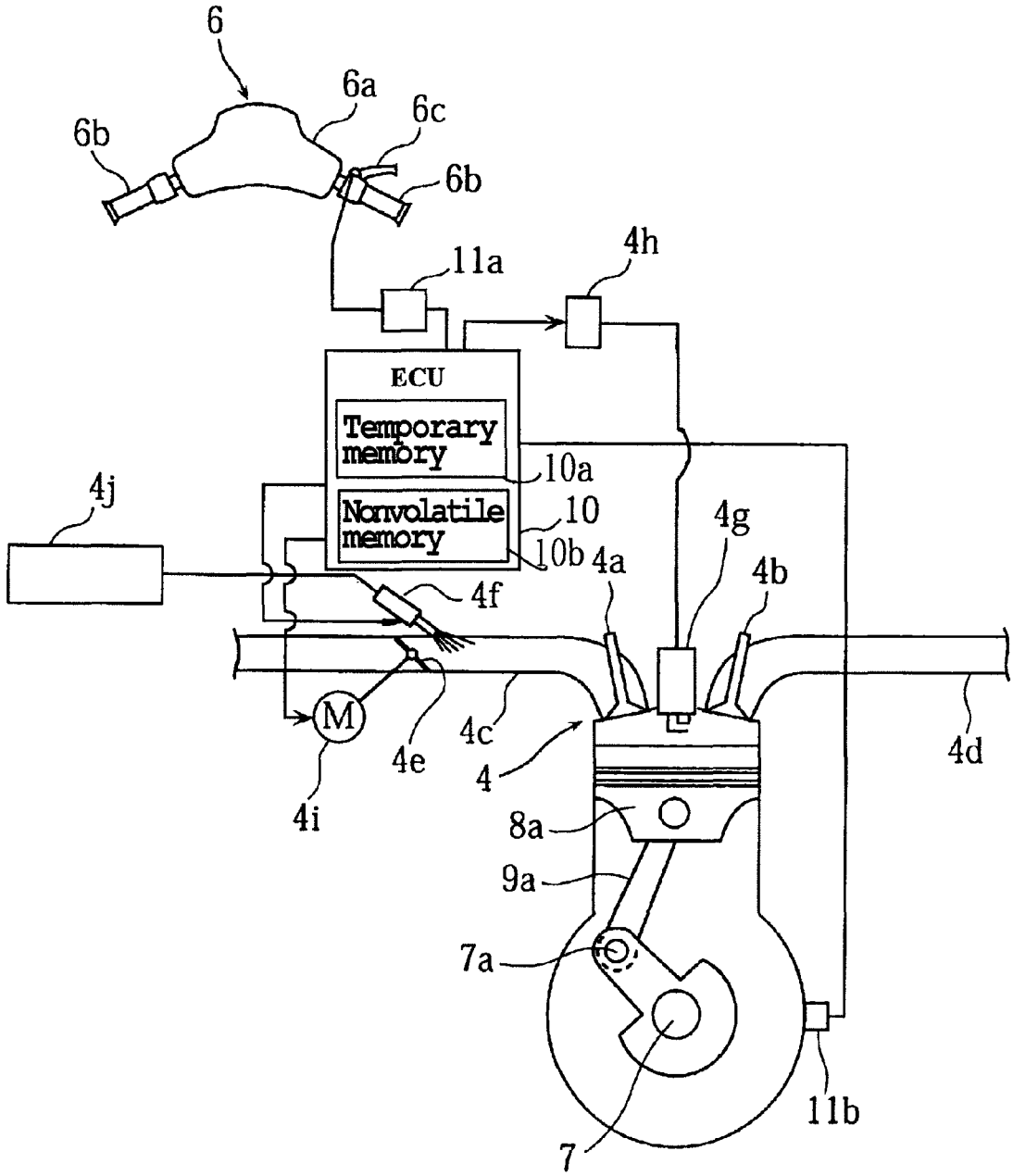
FIG. 2 is a schematic block diagram and partial schematic sectional view of the engine.
Figure 3:
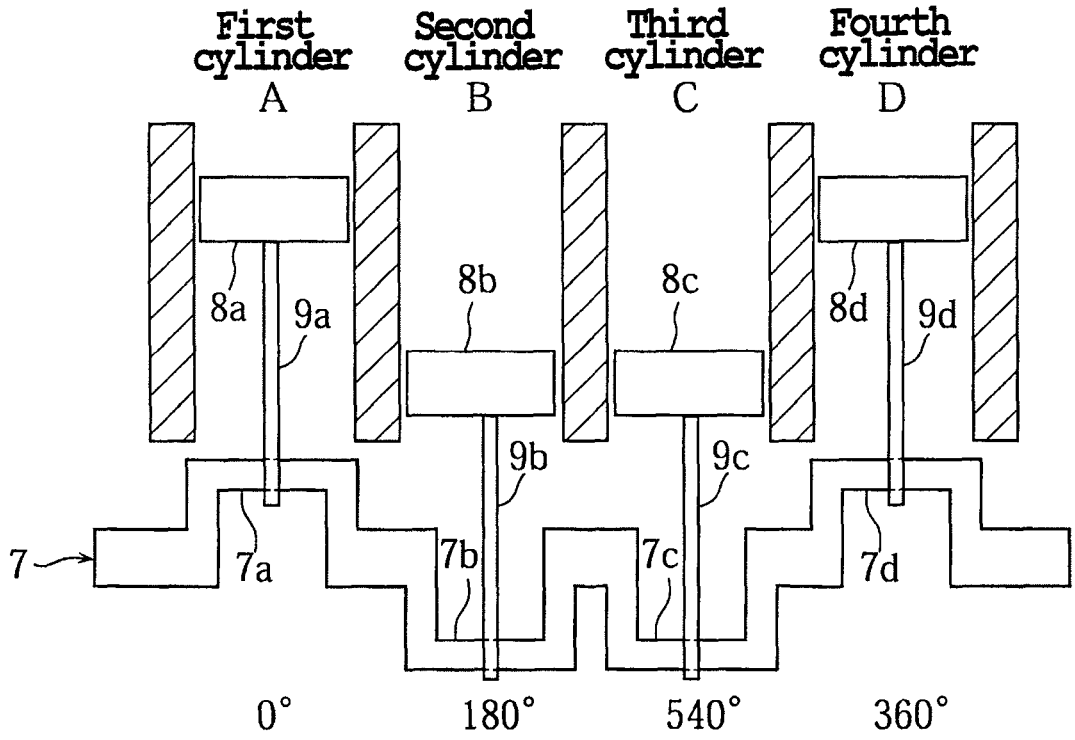
FIG. 3 is a schematic block diagram showing example cylinder positions of the engine.
Figure 5:
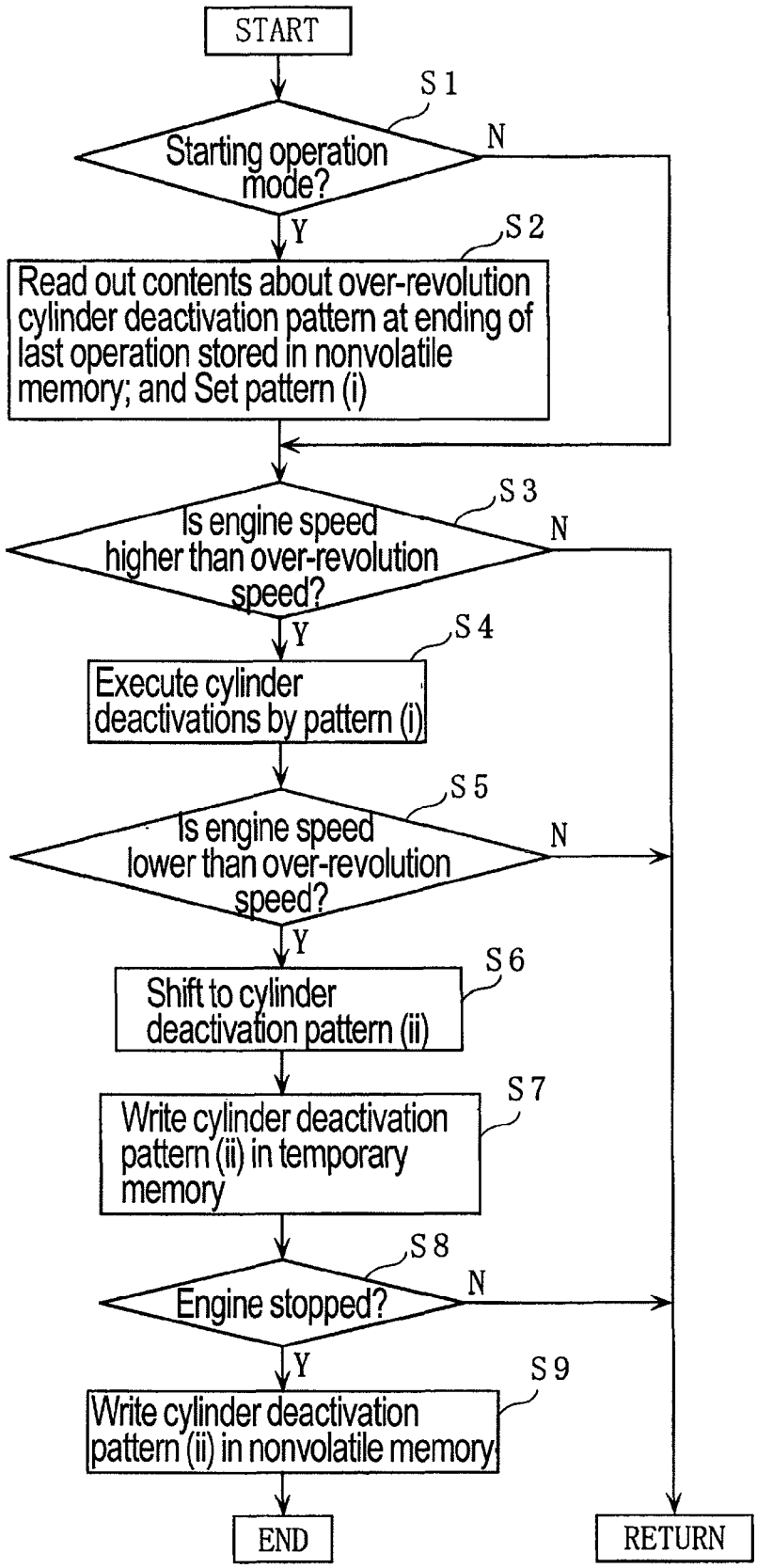
FIG. 5 is a flowchart illustrating a control routine that can be used to control the engine.
Figure 6:
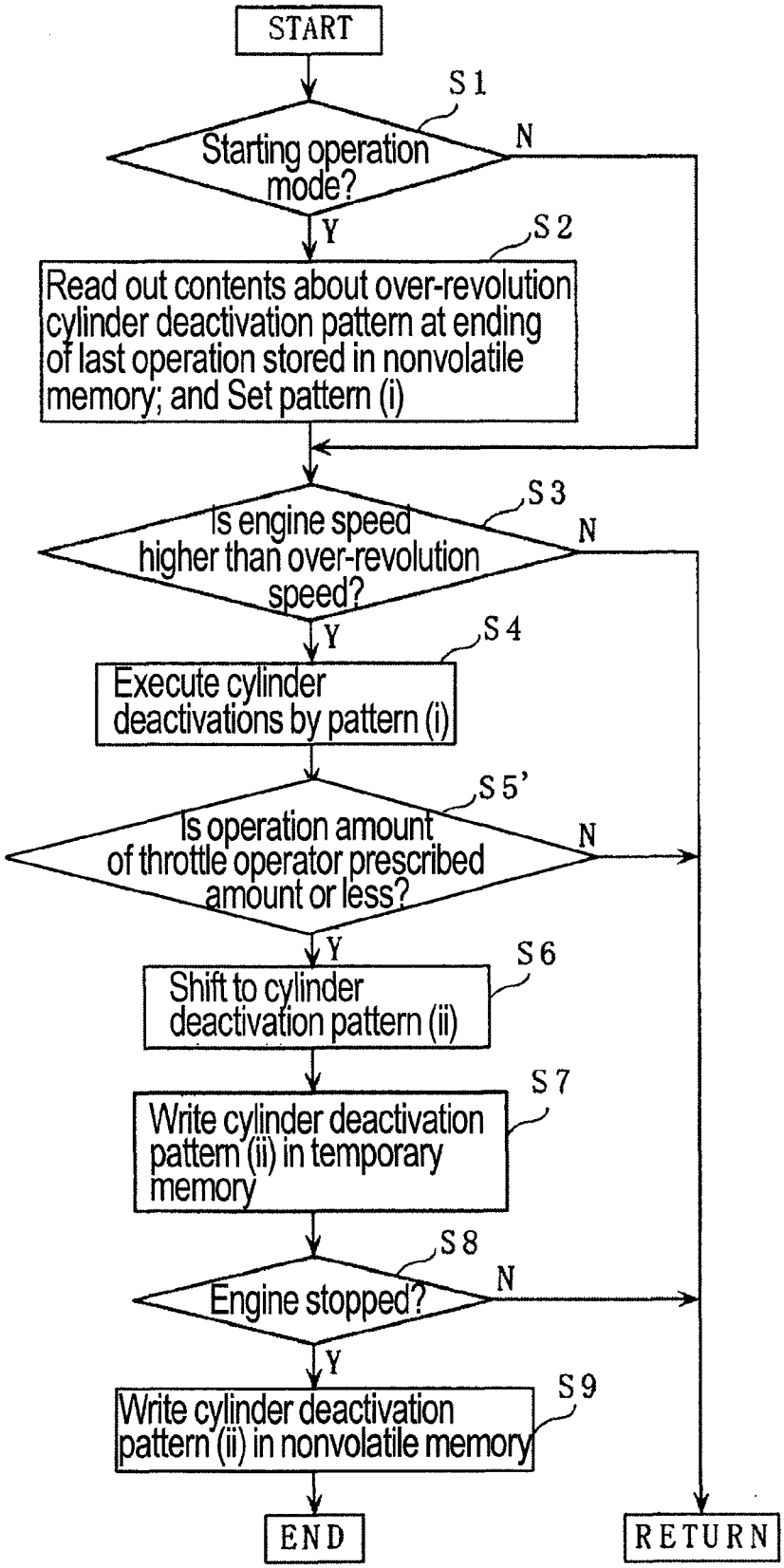
FIG. 6 is a flow chart illustrating a modification of the flow control routine of FIG. 5.

FIG. 1 is a side view of the small planing boat 1. FIG. 2 is schematic block diagram of an engine control device. FIG. 3 is a schematic view for describing cylinder dispositions and an ignition sequence. FIG. 4 is a chart showing cylinder deactivation sequence data. FIGS. 5 and 6 are flowcharts for explaining phased cylinder deactivations.

A hull 2 of the small planing boat 1 can be made of resin (FRP), or other materials. A lower hull portion 2*a* and an upper deck 2*b* can be tightly joined together by a gunwale 2*c* in a closed manner.

A straddle type seat 2*d* can be installed on the deck 2*b*. A steering handlebar assembly 6 can be disposed in front of the seat 2*d*. The handlebar assembly 6 can have a handlebar 6*a* supported rotatably to right and left. Grips 6*b*, 6*b* that a rider can grip can be put on right and left ends of the handlebar 6*a*.

A throttle operator 6*c* can be disposed in the right grip 6*b*. A traveling direction of the boat 1 can be adjusted by rotating the handlebar 6*a* to right and left. A speed of the hull 2 can be increased by rotating the throttle operator 6*c* toward the rider him/herself A propulsion unit 3 for propelling the hull 2 can be disposed in the hull 2. The propulsion unit 3 can have an engine 4 disposed in an engine compartment 2*f* and a water jet pump 5 disposed in a pump chamber 2*g* of the hull 2. The water jet pump 5 can include an impeller 5*b* driven to rotate by the engine 4 to thereby generate and discharge a water jet rearwardly from the stern of the boat 1. A reference numeral 2*h* denotes a bulkhead defining the engine compartment 2*f* and the pump room 2*g* in the hull 2.

The water jet pump 5 can have a water inlet port 5*a* opening on a bottom surface 2*e* of the hull 2, an impeller 5*b* rotatably disposed in the water inlet port 5*a* and coupled to an output shaft of the engine 4 by a transmission shaft 5*d*, and a steering nozzle 5*c* disposed in an exit part of the water inlet port 5*a*. The steering nozzle 5*c* can be operatively coupled to the steering handlebar assembly 6; turns to the right and left corresponding to turns of the steering handlebar assembly 6 to the right and left which thereby change a direction of the water jet discharged from the steering nozzle and thereby change a traveling direction of the hull 2. The water inlet port 5*a* opens in front of a rear end 2*i* of the bottom surface 2*e*.

The engine 4 can be a so-called four-cycle in-line four-cylinder type engine having a first cylinder A, a second cylinder B, a third cylinder C, and a fourth cylinder D disposed along a crankshaft 7. However, other engines, having other numbers of cylinders, other cylinder configurations, and operating on other principles of operation can also be used. The engine 4 can be disposed in the engine compartment 2*f* with the crankshaft 7 disposed along the fore-and-aft direction. The first cylinder A and the fourth cylinder D are the cylinders positioned at both the ends of the "cylinder line" as that term is used herein. The second cylinder B and the third cylinder C are the cylinders positioned between the cylinders at both the ends of the "cylinder line".

Pistons 8*a* through 8*d* of the first cylinder A through the fourth cylinder D can be coupled to a first crankpin 7*a* through a fourth crankpin 7*d* of the crankshaft 7 via respective connecting rods 9*a* through 9*d*. If a phase angle of the first crankpin 7*a* is set to 0°, phase angles of the second crankpin 7*b*, the third crankpin 7*c*, and the fourth crankpin 7*d* can be set to 180°, 540°, and 360°, respectively. An ignition sequence can be set to a sequence of the first cylinder A, the second cylinder B, the fourth cylinder D, and the third cylinder C. However, other configurations and ignition sequences can also be used.

Openings of an intake port 4*c* and an exhaust port 4*d* to a combustion chamber are opened or closed by intake valves 4*a* and exhaust valves 4*b* in each of the cylinders. An electrode of an ignition plug 4*g* can be positioned in the combustion chamber. An ignition coil 4*h* can be connected to the ignition plug 4*g*.

A throttle valve 4*e* can be configured to adjust a passage area of the intake port 4*c* and can be disposed in a midway part of the intake port 4*c*. A fuel injector 4*f* can be disposed downstream of the throttle valve 4*e*. An opening degree of the throttle valve 4*e* can be controlled by a throttle motor 4*i* corresponding to an operation amount of the throttle operator 6*c* by a rider of the boat. A fuel supply system 4*j* constructed with a fuel tank, a fuel pump, etc. can be connected to the fuel injector 4*f*.

The engine 4 can include an accelerator position sensor 11*a* for detecting an opening degree of the throttle operator 6*c*, a crank angle sensor 11*b* for detecting a rotational angle of the crankshaft 7. An ECU 10, to which detection signals of those sensors are input, can serve as an operation control device configured to perform engine control functions.

For example, the ECU 10 can be configured to obtain an engine speed from a crank angle input from the crank angle sensor 11*b*. The ECU 10 can also control an opening degree of the throttle valve 4*e* via the throttle motor 4*i* corresponding to the operation amount of the throttle operator 6*c* by a rider of the boat. Further, the ECU 10 can be configured to control an opening timing of the fuel injector 4*f*, a period of the opening, and a timing of ignition by the ignition plug 4*g* corresponding to the opening degree. Thereby, the ECU 10 can be configured to control an operational state of the engine 4. The ECU 10 can also include a temporary memory (for example, RAM: Random Access Memory) 10*a* and a nonvolatile memory (for example, ROM: Read Only Memory) 10*b* which can serve as "memory devices".

The ECU 10 can also be configured to execute cylinder deactivating operations, for example, when the engine speed input from the engine speed sensor 11*b* rises to or above a predetermined speed, which can be preset (an over-revolution speed). For example, if the engine speed does not fall bellow the over-revolution speed after a first phase cylinder deactivation in which one cylinder is deactivated, the cylinder deactivation operation moves to a Second phase cylinder deactivation in which two cylinders are deactivated.

As in such a manner, the ECU 10 makes phased cylinder deactivating operations such that the number of deactivated cylinders is changed in a phased manner. Further, the ECU 10 can include a plurality of cylinder deactivation sequence data (or "schedules") for determining sequences of cylinders to be deactivated as the number of deactivated cylinders is increases in a phased manner. Additionally, the ECU 10 can be configured to shift or switch between different cylinder deactivation sequence schedules corresponding to an operational state of the engine.

For example, as shown in FIGS. 4(*a*), (*b*), (*c*), and (*d*), the ECU 10 includes four different deactivation sequence schedules, including pattern (i), pattern (ii), pattern (iii), and pattern (iv). In FIGS. 4, black squares represent activated cylinders, and white squares represent deactivated cylinders.

In the pattern (i), if the engine speed exceeds the over-revolution speed, the first cylinder A is deactivated in the first phase deactivation. If the over-revolution state is not settled (e.g., if the engine speed does not fall below the over-revolution speed), the fourth cylinder D can be further deactivated in the second phase deactivation. Similarly, the second cylinder B is next deactivated in a third phase deactivation, and further the third cylinder C is finally deactivated in a fourth phase deactivation. The third cylinder C may be deactivated instead of the second cylinder B in the third phase deactivation.

In the pattern (ii), the second cylinder B can be deactivated in the first phase deactivation. The third cylinder C, the fourth cylinder D, and the first cylinder A can additionally be deactivated in the second, third, and fourth phase deactivations. In this pattern (ii), the cylinders rotating until a latter half (high speed rotations) are positioned at both the ends of the cylinder line, and they are the first cylinder A and the fourth cylinder D, that are not next to each other. Therefore, load applied to the engine can be better spread, and rotational fluctuations due to the cylinder deactivations can be further reduced. The first cylinder A may be deactivated instead of the fourth cylinder D in the third phase deactivation.

In the pattern (iii), the fourth cylinder D can be deactivated in the first phase deactivation. The first cylinder A, the third cylinder C, and the second cylinder B can additionally be deactivated in the second, third and fourth phase deactivations. The second cylinder B may be deactivated instead of the third cylinder C in the third phase deactivation.

Further, in the pattern (iv), the third cylinder C can be deactivated in the first phase deactivation. The second cylinder B, the first cylinder A, and the fourth cylinder D can additionally be deactivated in the second, third and fourth phase deactivations. The fourth cylinder D may be deactivated instead of the first cylinder A in the third phase deactivation.

Herein, the ignition sequence of the engine 4, in accordance with some embodiments, can be a sequence of the first cylinder A, the second cylinder B, the fourth cylinder D, and the third cylinder C. All the patterns (i) through (iv) can be set to sequences different from the ignition sequence.

The engine 4 has a cylinder pair AD positioned at both the ends of the cylinder line including the first cylinder A and the fourth cylinder D positioned at both the ends of the cylinder line, that is, positioned close to both ends of the crankshaft 7. A cylinder pair BC can be positioned between the cylinders at both the ends of the cylinder line including the second cylinder B and the third cylinder C interposed between the cylinder pair AD positioned at both the ends of the cylinder line. In any of the patterns (i) through (iv), either cylinder pair (two cylinders) between the cylinder pair AD positioned at both the ends of the cylinder line and the cylinder pair BC positioned between the cylinders at both the ends of the cylinder line can be deactivated first in the first and second phase deactivations, and the other cylinder pair can be deactivated in the third and fourth phase deactivations.

Specifically, in the patterns (i) and (iii), the two cylinders of the cylinder pair AD positioned at both the ends of the cylinder line are first deactivated in the first and second phase deactivations. Thereafter, the two cylinders of the cylinder pair BC positioned between the cylinders at both the ends of the cylinder line are deactivated in the third and fourth phase deactivations. In the patterns (ii) and (iv), the two cylinders of the cylinder pair BC positioned between the cylinders at both the ends of the cylinder line are first deactivated in the first and second phase deactivations. Thereafter, the two cylinders of the cylinder pair AD positioned at both the ends of the cylinder line are deactivated in the third and fourth deactivations.

The ECU 10 can be configured in a manner such that the patterns are shifted in an order of (i), (ii), (iii), and (iv), and thus the cylinders deactivated in the first phase deactivations are the first cylinder A, the second cylinder B, the fourth cylinder D, and the third cylinder C, respectively. As such, is it less likely for certain cylinders to be deactivated more than others and less likely that certain cylinders are kept activated during over-revolution states more than other cylinders.

The ECU 10 can also be configured to shift the cylinder deactivation sequence schedules to be used in an order of patterns (i), (ii), (iii), and (iv) corresponding to the operational state of the engine. For example, if the engine speed rises to an over-revolution state and the cylinder deactivating operation of the pattern (i) is executed causing the engine speed to fall below the over-revolution speed, the cylinder deactivation sequence data can be shifted to the pattern (ii), and thereafter shifted to the patterns (iii) and (iv) in turn.

The ECU 10 can be configured to store the newest (or "latest" or "last") cylinder deactivation sequence schedule, for example, the pattern (i) in the temporary memory during operation, and to store the newest cylinder deactivation sequence data in the nonvolatile memory when the engine 4 is stopped. The ECU 10 can be configured to make a shift from the pattern (i), which is the stored previous cylinder deactivation sequence data, to the pattern (ii), which is other cylinder deactivation sequence data, when the engine 4 is restarted.

The FIG. 5 shows an example of a flow of shifts among the cylinder deactivation sequence schedules. If a control program is started and the engine is in a starting operation mode (step S1), the ECU 10 reads out a cylinder deactivation pattern at the end of a previous operation from the nonvolatile memory. A pattern next to the stored pattern, for example, the pattern (i) is set (step S2). If the operation is started, and the ECU 10 detects that the engine speed exceeds the over-revolution speed (step S3), the cylinder deactivating operation, according to the pattern (i), is executed (step S4).

Thereafter, if the ECU 10 determines that the engine speed falls lower than the over-revolution speed (step S5), the ECU 10 makes a shift to the cylinder deactivation sequence pattern (ii) (step S6), and the pattern (ii) can be written into the temporary memory. The pattern (ii) can be written into the nonvolatile memory when the engine stops (step S9).

In a next engine starting procedure, the pattern (iii), which is next to the deactivation pattern stored in previous operation, can be set. If the engine speed exceeds the over-revolution speed, the cylinder deactivating operation can be executed according to the pattern (iii). If the engine speed falls to a speed lower than the over-revolution speed, the pattern can be shifted to the cylinder deactivation pattern (iv). Now, the cylinder deactivation pattern (iv) can be written into the non-volatile memory when the engine is stopped, and similarly the cylinder deactivation pattern (i) can be set in a next engine starting procedure.

The small planing boat 1 in accordance with at least some embodiments can be constructed to include the patterns (i) through (iv) as the cylinder deactivation sequence schedules for indicating the sequences in increasing the number of deactivated cylinders and shifts are made among the patterns corresponding to the operational state of the engine. For example, the cylinders first deactivated are changed in an order of the first cylinder A (pattern (i)), the second cylinder B (pattern (ii)), the fourth cylinder D (pattern (iii)), and the third cylinder C (pattern (iv)) every occurrence of the over-revolution state. Thereby, the cylinders that are not deactivated and subject to high speeds change in accordance with the patterns. Mechanical load due to the over-revolution which can be unevenly distributed to the crankshaft and cylinder bodies can be more effectively spread.

A shift can be made between the cylinder deactivation sequence schedules when the engine speed becomes lower than the prescribed speed (the over-revolution speed). Therefore, the cylinder deactivation sequences can be shifted every occurrence of the over-revolution state, and thus mechanical load unevenly distributed to each cylinder can be more effectively spread.

Further, newest cylinder deactivation sequence schedule, for example, the pattern (i), are stored while the engine is operating, and a shift is made from the pattern (i), which is a stored previous pattern, to the pattern (ii), which is the next cylinder deactivation sequence schedule, when the engine is restarted. Accordingly, shifts can be certainly made between the cylinder deactivation sequence schedules every starting of the engine.

In some embodiments, the sequence for increasing the deactivated cylinders in any of the patterns (i) through (iv) can be made different from the ignition sequence A-B-D-C. Therefore, rotational fluctuations due to the cylinder deactivations can be better reduced. The ignition sequences in the present inventions are not limited to the sequence A-B-D-C, but the ignition sequence is different from the cylinder deactivation sequence. Specifically, the ignition sequence may be B-D-C-A, C-A-B-D, or D-C-A-B, for example.

Further, the cylinder deactivation sequence schedules can be shifted in the straight four-cylinder engine 4, and thus load applied to the crankshaft 7, bearings thereof, and the cylinders can be reduced. Therefore, less durability is required for the crankshaft, and the engine can be made compact.

That is, comparing with a V-type engine, a straight engine has a longer crankshaft, and more cylinders sandwiched by cylinders disposed on both their sides as the second cylinder B and the third cylinder C do in this case. In a V-type four-cylinder engine, there are no cylinders sandwiched by cylinders disposed on both their sides. The same cylinders are constantly subject to the over-revolution state in the conventional phased deactivation method. Therefore, larger mechanical loads are applied to the crankshaft, and thermal loads applied to the concerned cylinders become larger as the over-revolution repeats more times. The size of an engine can be increase to increase durability. However, increasing the size of the engine can be avoided by using the inventions disclosed herein.

Either the cylinder pair AD (the cylinders A and D) positioned at both the ends of the cylinder line or the cylinder pair BC (the cylinders B and C) positioned between the cylinders at both the ends of the cylinder line is first deactivated in the first and second phase deactivations. The other cylinder pair can be deactivated in the third and fourth phase deactivations. Therefore, the cylinders rotating until a latter half of the phased cylinder deactivations (high speed rotations) are dispersed to both the ends or the center part of the cylinder line. Load applied to the crankshaft 7 can thus be spread in a more balanced manner. At the same time thermal loads applied to the second cylinder B and the third cylinder C can be further reduced.

The patterns (i), (ii), (iii), and (iv) can be shifted one after another. The first phase deactivations in the patterns shifted in turn can be made in a cycle of deactivations of the first cylinder A—the second cylinder B—the fourth cylinder D—the third cylinder C. Large loads due to rotating until a latter half of the phased cylinder deactivations can be distributed alternately to the cylinders A and D positioned at both the ends of the cylinder line and the cylinders B and C positioned between the cylinders at both the ends of the cylinder line. Also, the deactivation sequences can be changed each time. Therefore, loads applied to the cylinders can be better spread to each of them.

With regard to some of the embodiments described above, when over-revolution occurs, the cylinder deactivating operation by the pattern (i) is made, thereby the engine speed becomes lower than the over-revolution speed, thereafter the cylinder deactivation sequence schedule can be shifted to the pattern (ii), and in turn shifted to the pattern (iii) and finally the pattern (iv). However, the shift method of the cylinder deactivation sequence schedule is not limited hereto.

For example, as shown in FIG. 6, if the cylinder deactivation sequence schedule is initially the pattern (i), a shift may be made to the pattern (ii) when the operation amount of the throttle operator operated by a rider of the boat becomes less than a prescribed amount (for example, when the operation amount of the throttle operator becomes zero and the throttle operator is in an idle opening degree position) (step S5') after the engine speed exceeds the over-revolution speed (steps S1 through S4). In the case that the operation amount of the throttle operator becomes lower than the prescribed amount after the engine becomes the over-revolution state again, shifts are made to the pattern (iii) and thereafter to the pattern (iv).

Such a construction allows reduction in computation load to the ECU 10. That is, the predetermined engine speed can be set to a low value in which the engine is obviously not in the over-revolution state. An engine speed for determining if the operation amount of the throttle operator becomes the prescribed amount or less or not is much smaller comparing with an engine speed for determining if the engine speed is lower than that of over-revolution state or not. Therefore, computation load can be reduced.

In some embodiments noted above, the ignition sequence is the first cylinder A, the second cylinder B, the fourth cylinder D, and the third cylinder C. However, the ignition sequences that can be used with the present inventions are not limited to this sequence.

In some embodiments utilizing the schedules of FIG. 7, the ignition sequence of the engine 4 can be, for example, a sequence of the first cylinder A, the third cylinder C, the fourth cylinder D, and the second cylinder B. In some embodiments, either the cylinder pair AD (the cylinders A and D) positioned at both the ends of the cylinder line or the cylinder pair BC (the cylinders B and C) positioned between the cylinders at both the ends of the cylinder line can be deactivated in the first and second phase deactivations. The other cylinder pair can be deactivated in the third and fourth phase deactivations. For example, following patterns (i)' through (iv)' are applied as the cylinder deactivation sequence schedule. Black squares represent ignited cylinders and white squares represent deactivated cylinders in FIG. 7, similarly to FIG. 4.

In the pattern (i)', the first cylinder A can be first deactivated in a first phase deactivation if the engine speed exceeds the over-revolution speed. If the over-revolution state is not settled, the fourth cylinder D can be further deactivated in a second phase deactivation. Similarly, the second cylinder C can be further deactivated in a third phase deactivation. The second cylinder B can be finally deactivated in a fourth phase deactivation.

In the pattern (ii)', the third cylinder C can be deactivated in the first phase deactivation. The second cylinder B, the fourth cylinder D, and the first cylinder A are additionally deactivated in the second, third, and fourth phase deactivations, respectively.

In the pattern (iii)', the fourth cylinder D can be deactivated in the first phase deactivation. The first cylinder A, the second cylinder B, and the third cylinder C are additionally deactivated in the second, third, and fourth phase deactivations.

In the pattern (iv)', the second cylinder B can be deactivated in the first phase deactivation. The third cylinder C, the first cylinder A, and the fourth cylinder D are additionally deactivated in the second, third, and fourth phase deactivations.

The ignition sequence of the engine 4 in accordance with some embodiments can be the first cylinder A, the third cylinder C, the fourth cylinder D, and the second cylinder B as described above. All the patterns (i)' through (iv)' are set to sequences different from the ignition sequence.

In any of the patterns (i)' through (iv)', either the cylinder pair AD positioned at both the ends of the cylinder line or the cylinder pair BC positioned between the cylinders at both the ends of the cylinder line can be deactivated in the first and second phase deactivations, and the other cylinder pair can be deactivated in the third and fourth phase deactivations.

For example, in the patterns (i)' and (iii)', the two cylinders A and D positioned at both the ends of the cylinder line are deactivated in the first and second phase deactivations. The two cylinders B and C positioned between the cylinders at both the ends of the cylinder line are deactivated in the third and fourth phase deactivations. In the patterns (ii)' and (iv)', the two cylinders B and C positioned between the cylinders at both the ends of the cylinder line are deactivated in the first and second phase deactivations. The two cylinders A and D positioned at both the ends of the cylinder line are deactivated in the third and fourth phase deactivations.

Shifts can be made in an order of the patterns (i)', (ii)', (iii)', and (iv)', and thus the cylinders deactivated in the first phase deactivations are the first cylinder A, the third cylinder C, the fourth cylinder D, and the second cylinder B, respectively.

In some embodiments, shifts are made in an order of the patterns (i), (ii), (iii), and (iv). However, the orders of the shifts in accordance with the present inventions are not limited to such embodiments. For example, the cylinder deactivation sequence schedule may include a fifth cylinder deactivation sequence schedule in which the cylinder deactivated in the first phase deactivation is either of the cylinders A and D positioned at both the ends of the cylinder line, and sixth cylinder deactivation sequence schedule in which the cylinder deactivated in the first phase deactivation can be either of the cylinders B and C positioned between the cylinders at both the ends of the cylinder line. Additionally, shifts can be made alternately between the fifth and sixth cylinder deactivation sequence schedules.

With such a construction, large loads due to rotating until a latter half of the phased cylinder deactivations can be distributed alternately to the cylinders A and D positioned at both the ends of the cylinder line and the cylinders B and C positioned between the cylinder positioned at both the ends of the cylinder line. Further, in some embodiments, only two kinds of the cylinder deactivation sequence schedules are used, and thus required memory capacity can be reduced.

A so-called electronic control throttle by which the throttle motor 4*i* adjusts an opening degree of the throttle valve 4*e* corresponding to an operation amount of the throttle operator 6*c* by a rider of the boat can be applied in the above embodiments. However, the present inventions of course can be applied to a type such that the throttle operator 6*c* and the throttle valve 4*e* are directly coupled together by a wire, etc., and thereby an opening degree of the throttle can be adjusted.

The present inventions of course can be applied to small planing boats including an engine having a supercharger, a turbocharger, etc.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A small planing boat comprising:

a multi-cylinder engine; and a jet pump configured to be driven by the engine and to propel a hull by drawing in and jetting out water;

wherein the engine is configured to change the number of deactivated cylinders in a phased manner corresponding to a speed of the engine when the engine speed becomes a prescribed speed or more, the engine further comprising:

a memory device arranged to store a plurality of cylinder deactivation sequence schedules defining sequences of cylinders that are deactivated and increasing the number of deactivated cylinders in a phased manner, and an operation control device configured and programmed to deactivate the cylinders of the engine in a phased manner in accordance with the cylinder deactivation sequence schedule stored in the memory device, and wherein the operation control device is configured and programmed to shift the cylinder deactivation sequence schedule to be read out from the memory device to another cylinder deactivation sequence schedule corresponding to an operational state of the engine; and wherein the operation control device is configured and programmed to store a newest cylinder deactivation sequence schedule while the engine is operated, and to shift a stored previous cylinder deactivation sequence schedule to another cylinder deactivation sequence schedule when the engine is restarted.

2. The small planing boat according to claim 1, wherein the operation control device is further configured and programmed to shift the cylinder deactivation sequence schedule to another cylinder deactivation sequence schedule having a different sequence of cylinders that are deactivated when the engine speed becomes lower than the prescribed speed.

3. The small planing boat according to claim 2, wherein the cylinder deactivation sequence schedules are configured in a manner such that a sequence to increase the number of deactivated cylinders is different from an ignition sequence.

4. The small planing boat according to claim 2, wherein the plurality of cylinders are disposed in-line in the engine.

5. The small planing boat according to claim 1, wherein the operation control device is further configured and programmed to shift the cylinder deactivation sequence schedule to another cylinder deactivation sequence schedule having a different sequence of cylinders that are deactivated when an operation amount of a throttle operator operated by a rider of the boat becomes a prescribed amount or less after the engine speed becomes the prescribed speed or more.

6. The small planing boat according to claim 5, wherein the cylinder deactivation sequence schedules are configured in a manner such that a sequence to increase the number of deactivated cylinders is different from an ignition sequence.

7. The small planing boat according to claim 1, wherein the cylinder deactivation sequence schedules are configured in a manner such that a sequence to increase the number of deactivated cylinders is different from an ignition sequence.

8. The small planing boat according to claim 1, wherein the plurality of cylinders are disposed in-line in the engine.

9. The small planing boat according to claim 1, wherein the engine is a four-cylinder engine in which two cylinders positioned at both ends of a cylinder line and two cylinders positioned between the two cylinders at both the ends of the cylinder line are disposed in line;

wherein an ignition sequence of the engine is;

one cylinder of the cylinders positioned at both the ends of the cylinder line;

the other cylinder of the cylinders positioned at both the ends of the cylinder line;

one cylinder of the cylinders positioned between the cylinders at both the ends of the cylinder line; and the other cylinder of the cylinders positioned between the cylinders at both the ends of the cylinder line; and wherein the operation control device first deactivates two cylinders that are either the cylinders positioned at both the ends of the cylinder line or the cylinders positioned between the cylinders at both the ends of the cylinder line in first and second phase deactivations, and deactivates the other two cylinders in third and fourth phase deactivations.

10. The small planing boat according to claim 9, wherein the cylinder deactivation sequence schedules stored in the memory device includes;

a first cylinder deactivation sequence schedule in which the cylinder deactivated in the first phase deactivation is one of the cylinders positioned at both the ends of the cylinder line;

a second cylinder deactivation sequence schedule in which the cylinder deactivated in the first phase deactivation is one of the cylinders positioned between the cylinders at both the ends of the cylinder line;

a third cylinder deactivation sequence schedule in which the cylinder deactivated in the first phase deactivation is the other of the cylinders positioned between the cylinders at both the ends of the cylinder line; and a fourth cylinder deactivation sequence schedule in which the cylinder deactivated in the first phase deactivation is the other of the cylinders positioned at both the ends of the cylinder line; and wherein the operation control device makes shifts among the first through fourth cylinder deactivation sequence schedule in a manner such that the first phase deactivations are made in a cycle of deactivations of;

one of the cylinders positioned at both the ends of the cylinder line;

one of the cylinders positioned between the cylinders at both the ends of the cylinder line;

the other of the cylinders positioned at both the ends of the cylinder line; and the other of the cylinders positioned between the cylinders at both the ends of the cylinder line, and wherein this cycle is repeated.

11. The small planing boat according to claim 9, wherein the cylinder deactivation sequence schedules stored in the memory device include;

a first cylinder deactivation sequence schedule in which the cylinder deactivated in the first phase deactivation is either of the cylinders positioned at both the ends of the cylinder line; and a second cylinder deactivation sequence schedule in which the cylinder deactivated in the first phase deactivation is either of the cylinders positioned between the cylinders at both the ends of the cylinder line; and wherein the operation control device is configured to make shifts alternately between the first and second cylinder deactivation sequence schedules.

12. The small planing boat according to claim 1, wherein the operation control device always sequentially increases the number of deactivated cylinders.

13. The small planing boat according to claim 1, wherein a first cylinder that is deactivated in the another cylinder deactivation sequence schedule is different from a first cylinder that is deactivated in the cylinder deactivation sequence schedule.

* * * * *